US006213130B1

(12) United States Patent
Alessandrino

(10) Patent No.: US 6,213,130 B1
(45) Date of Patent: Apr. 10, 2001

(54) PONYTAIL HAIR STYLING METHOD

(76) Inventor: Lisa Alessandrino, 13 Rock Ave., Highland Mills, NY (US) 10930

( * ) Notice: Subject to any disclaimer, the term of this patent is extended or adjusted under 35 U.S.C. 154(b) by 0 days.

(21) Appl. No.: 09/613,189

(22) Filed: Jul. 10, 2000

(51) Int. Cl.[7] ..... A45D 8/36
(52) U.S. Cl. ..... 132/200; 132/275
(58) Field of Search ..... 132/200, 210, 132/246, 273, 275; 54/75, 76, 78; 119/607

(56) References Cited

U.S. PATENT DOCUMENTS 5,465,741 * 11/1995 Dvorak ..... 132/275
5,727,574 * 3/1998 Frye ..... 132/210
5,778,904 * 7/1998 Elsner ..... 132/275
6,009,882 * 1/2000 Schine et al. ..... 132/200
6,076,532 * 6/2000 Thomas et al. ..... 132/273

* cited by examiner

*Primary Examiner*—Todd E. Manahan
*Assistant Examiner*—David Comstock
(74) *Attorney, Agent, or Firm*—Myron Amer PC

(57) ABSTRACT

A ponytail hair style applied by a user without assistance by reaching behind and performing all of the steps by feel, using a slip knot to establish the ponytail and encircle it in helical turns within ties extending from the slip knot and joined at free ends just beyond the last helical turn by the insertion of a display object on one tie in a closed loop of elastic on the other tie.

1 Claim, 1 Drawing Sheet

PONYTAIL HAIR STYLING METHOD

The present invention relates generally to ponytail hair styles and more particularly to the implementing of these hair styles without the assistance of another person.

EXAMPLE OF THE PRIOR ART

The popularity of ponytail hair styles has resulted in extensive patent literature directed to diverse constructions applied to hair strands of a number providing a desired bulk in a rearwardly extending orientation, in which the patented constructions applied about the hair strands hold them in a well recognized configuration resembling that of a tail of a pony, and thus aptly known as and called a ponytail. Exemplifying this extensive patented literature is U.S. Pat. No. 5,465,741 for "Hair Wrap Device" issued to Dvorak on Nov. 14, 1995. Despite the diversity of their apparent simple construction, the patented devices, such as that of the '741 patent, requires the assistance of another person because the hair strands extend rearwardly from behind the head of the user and in this hard to reach position are correspondingly difficult to bind together and thus be maintained in a ponytail-resembling shape or configuration. More particularly, the hair strands are helically wrapped with cords or ties, but provision is not adequately made to hold the hair strands in place during the wrapping, and the ending helical coils or turns about the hair strands are difficult to unite to each other by a user reaching back and attempting this chore by feel. Thus, the ponytail hair style of the '741 patent and all other known implemented ponytail hair styles are done with assistance.

Broadly, it is an object of the present invention to implement ponytail hair styling overcoming the foregoing and other shortcomings of the prior art.

More particularly, it is an object to achieve readily unassisted ponytail hair styling to contribute to this hair style, already very popular with teenagers, enhanced facility and use in grooming for school and like occasions, when time is limited and another's assistance is not available.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
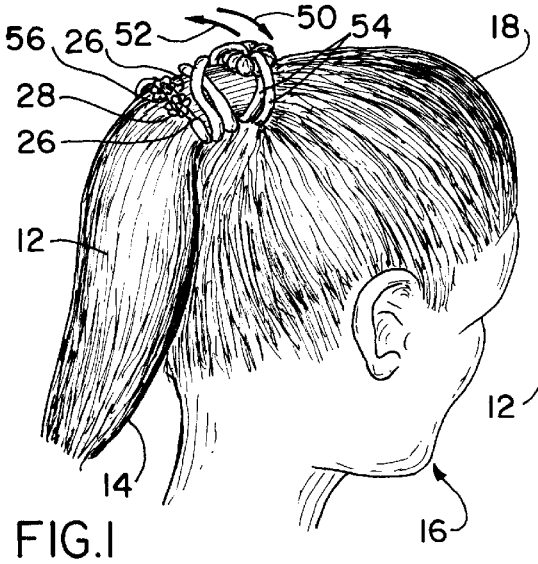
FIG. 1 is a side elevational perspective view of a first ponytail hair style according to the present invention.
Figure 3:
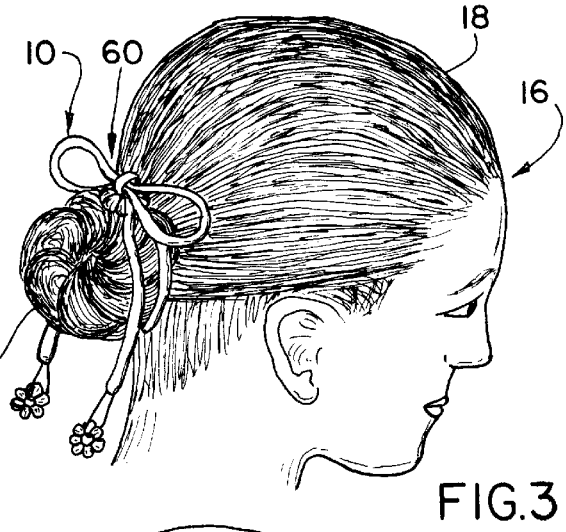
Figure 2:
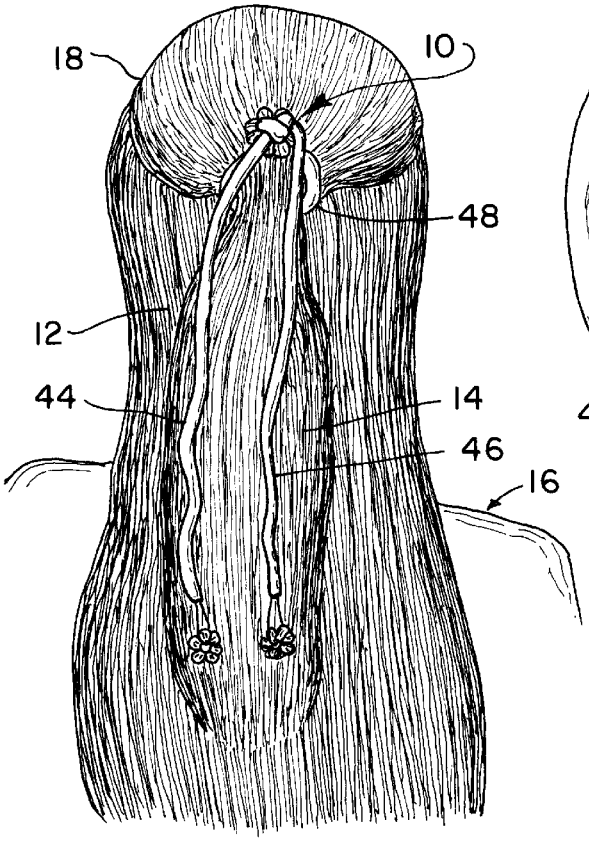
FIG. 2 is a rear elevational view of a second ponytail hair style according to the present invention.
Figure 4:
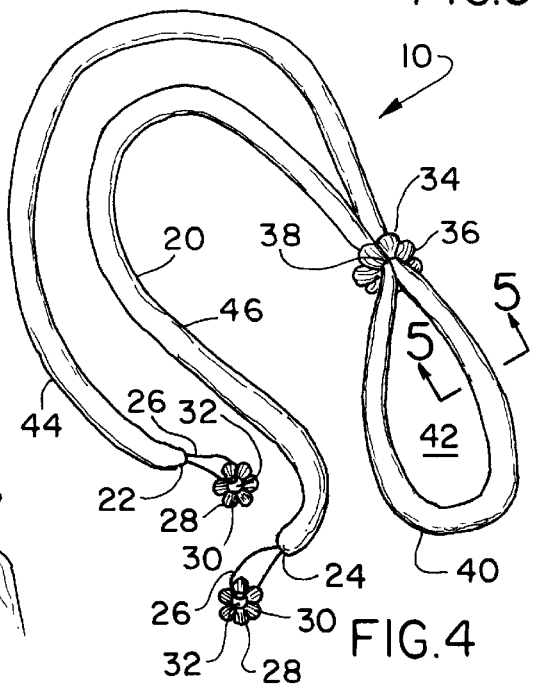
Figure 5:
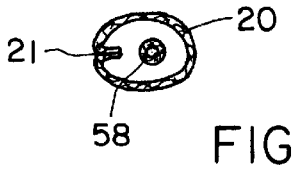

FIG. 3, like FIG. 1, is similarly a side elevational view, but of a third hair style according to the present invention;

FIG. 4 is an isolated view of a ponytail-engaging component for implementing the hair styles of FIGS. 1, 2 and 3; and FIG. 5 is a cross sectional view taken along line 5—5 of FIG. 4.

As is known from common experience, a ponytail is a popular hair style of choice and to implement this hair style diverse ponytail-engaging components are illustrated and described in the patent literature, as exemplified by the chronological list of U.S. Pat. No. 3,301,266 for "Hair Holder" issued to E. Hoffman on Jan. 31, 1967, U.S. Pat. No. 3,751,769 for "Fastening Devices" issued to Reiner on Aug. 14, 1973, U.S. Pat. No. 5,167,245 for "Hair Tying Apparatus and Method of Use" issued to Harriet on Dec. 1, 1992, and U.S. Pat. No. 5,465,741 or "Hair Wrap Device" issued to Dvorak as recently as Nov. 14, 1995.

Despite the diversity of their apparent simple construction, the ponytail hair styles which are provided require the assistance of another person, and is a shortcoming overcome by the ponytail-engaging component, generally designated 10 which, as will be better understood as description proceeds, is readily applied to hair strands 12 to achieve a ponytail configuration 14 by a user 16 merely reaching back behind her head 18 and, to the ponytail 14 thusly made available completing any one of three hair styles of FIGS. 1, 2 or 3, and possibly additional hair styles limited only by the creative bent of the user 16.

Component 10, by function aptly termed a "lasso loop" and hereinafter referred to as such, consists of a tube 20 preferably of stretchable fabric construction material stitched longitudinally as at 21 and which in a preferred embodiment measures thirty-two inches from one end 22 to an opposite end 24. In each end, there is attached by sewing or the like an extending closed loop 26 of elastic cord-like construction material on which is a cooperating display member 28 having an appropriate ornamental display surface 30 and preferably a circular shape bounding a circular central opening 32 through which the closed loop configuration is achieved before attachment of the ends of the elastic cord in a tube end 22, 24. The elasticity of each loop 26 enables one display member 28 of one loop to be readily inserted by feel in the other closed loop and, of course, vice versa, and the size of the display member 28 is selected to be readily located, again by feel, by a user 16 reaching back behind her head 18.

Completing the lasso loop in an assembly for use is a decorative slide 34, preferably having a matching decorative surface 36, which additionally has a central opening 38 through which two lengths of the tube, each preferably half of its thirty-two inch length, are inserted with sliding clearance to enable sliding movement of the slide 34 along the inserted tube lengths. Thus, as depicted in FIG. 4, on one side of the slide 34 the tube assumes a closed loop configuration 40 bounding a ponytail-receiving opening 42, and on the opposite side of the slide 34 are unattached ties 44 and 46 each terminating with the engaged members 28.

To implement the hair styles of at least FIGS. 1–3, the user 16 reaches back and, by feel, threads an appropriate number of hair strands 12, i.e., a number providing a desired bulk in the ponytail to be styled, through the lasso loop opening 42, urges the slide 34 in movement along the ties 44, 46 up to the base or a position adjacent the user's scalp, and pulls the ties 44, 46 taut to provide a slip knot configuration 48. This provides the hair style depicted in FIG. 2 in which the ties 44 and 46 dangle unattached lengthwise of the ponytail.

In practice however, a further styling has proved more popular and is depicted in FIG. 1. To implement the hair style of FIG. 1, the user 16, again by feel and reaching behind her head 18 simultaneously winds with each hand in opposite helical clockwise and counterclockwise directions 50 and 52 the ties 44 and 46 about the ponytail 14 and is able to readily hold the helical turns 54 of the ties 44 and 46 in their encircling relation about the ponytail 14 by inserting one member 28 of one closed loop 26 through the other closed loop 26, since the elasticity of the loop construction material allows for this positioning and the elasticity upon release of the inserted member 28 draws the member 28 against an unoccupied site, as at 56, of a closed loop 26. The FIG. 1 hair style is thusly implemented in all respects without another's assistance and solely by the user 16 reaching back and manipulating the lasso loop 10 as described by feel.

To add body and also to facilitate handling of the tube 20, an elastic cord 58 is connected in extending relation between the loops 26 so as to serve as a core for the tube 20 and, in practice, makes it easier to apply the helical turns 54 about the ponytail 14 in implementing the hair style of FIG. 1 from the hair style of FIG. 2.

Additional styling, as depicted in FIG. 3, is readily achieved by the user 16 configurating a bow knot 60 of the unattached ties 44 and 46, instead of implementing the unassisted hair style of FIG. 1.

While the ponytail-engaging lasso loop for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For hair styled as a rearwardly extending ponytail, an improved method of implementing said styling without another's assistance comprising the steps of:

A. using for engagement of said ponytail a length of tube folded in half with a slide disposed thereon forming a closed loop forward of said slide and two tying lengths each extending rearwardly of said slide terminating in free ends in unconnected relation to each other and having on each a closed elastic loop and a decorative member for subsequent interconnection of said free ends;

B. reaching behind and threading strands of hair in a ponytail configuration through said formed closed loop;

C. reaching behind and urging said slide in movement forming a slip knot configuration about said ponytail;

D. reaching behind and separately winding said tying length, in opposite clockwise and counterclockwise helical turns about and rearwardly along said ponytail until a last helical turn is in adjacent position to said free ends; and E. reaching behind and inserting a one decorative member of a free end into a closed elastic loop of the other free end;

whereby said ponytail hair style is completed by said reaching behind activities without another's assistance.

* * * * *